United States Patent [19]

Bermingham et al.

[11] Patent Number: 4,766,711

[45] Date of Patent: Aug. 30, 1988

[54] BUILDING ELEMENT AND A CONSTRUCTION METHOD USING SUCH AN ELEMENT

[75] Inventors: Hubert P. M. Bermingham; Pietro Cavanna, both of London, England

[73] Assignee: Desert Systems Limited, England

[21] Appl. No.: 49,014

[22] Filed: Apr. 30, 1987

Related U.S. Application Data

[63] Continuation of Ser. No. 635,395, Jul. 30, 1984, abandoned.

[30] Foreign Application Priority Data

Aug. 3, 1983 [GB] United Kingdom ..... 8320902
Feb. 15, 1984 [GB] United Kingdom ..... 8403926

[51] Int. Cl.[4] ..... E04C 1/08

[52] U.S. Cl. ..... 52/404; 52/439; 52/570; 52/574

[58] Field of Search ..... 52/404, 439, 574, 608, 52/424, 425, 438, 436, 575, 565, 570, 609, DIG. 10

[56] References Cited

U.S. PATENT DOCUMENTS

| | | | |
|---|---|---|---|
| 785,072 | 3/1905 | Rickords | 52/570 |
| 1,770,082 | 7/1930 | McPherson | 52/570 |
| 2,146,549 | 2/1939 | Naylor | 52/DIG. 10 |
| 2,371,058 | 3/1945 | Marino | 52/439 |
| 2,624,193 | 1/1953 | Larson | 52/574 X |
| 3,355,849 | 12/1967 | Hancock | 52/574 X |
| 3,376,682 | 4/1968 | Briscoe | 52/436 X |
| 3,410,044 | 11/1968 | Moog . | |
| 3,449,878 | 6/1969 | Hern | 52/424 X |
| 3,552,076 | 1/1971 | Gregori . | |
| 3,686,791 | 8/1972 | Mills . | |
| 3,956,862 | 5/1976 | Alexandre, Jr. | 52/574 X |
| 4,416,097 | 11/1983 | Weir | 52/575 X |

FOREIGN PATENT DOCUMENTS

| | | | |
|---|---|---|---|
| 841341 | 8/1949 | Fed. Rep. of Germany . | |
| 871125 | 2/1955 | Fed. Rep. of Germany | 52/609 |
| 1070361 | 12/1959 | Fed. Rep. of Germany | 52/439 |
| 569337 | 4/1924 | France . | |
| 27323 | 6/1924 | France . | |
| 941496 | 1/1949 | France | 52/439 |
| 1520371 | 4/1968 | France . | |
| 1553217 | 1/1969 | France . | |
| 459557 | 9/1950 | Italy | 52/570 |
| 359602 | 8/1972 | Sweden . | |
| 327616 | 2/1958 | Switzerland | 52/425 |
| 25259 | 12/1899 | United Kingdom | 52/439 |
| 572576 | 10/1945 | United Kingdom . | |
| 581073 | 9/1946 | United Kingdom . | |
| 818791 | 8/1959 | United Kingdom . | |
| 943679 | 12/1963 | United Kingdom . | |
| 1185021 | 3/1970 | United Kingdom . | |
| 1287296 | 8/1972 | United Kingdom . | |
| 2033765A | 11/1978 | United Kingdom . | |

*Primary Examiner*—David A. Scherbel
*Assistant Examiner*—Richard E. Chilcot, Jr.
*Attorney, Agent, or Firm*—Hale and Dorr

[57] ABSTRACT

A lightweight building element is moulded in the form of a three or four sided shell defining an interior space for receiving a filler material. The element is trapezoidal in at least one elevation so as to be stackable with a plurality of identical elements for ease of transportation. The method of the invention involves laying the elements in courses and then filling the elements from above with a loose relatively heavy filler material such as gravel or sand to form a solid structure.

21 Claims, 5 Drawing Sheets

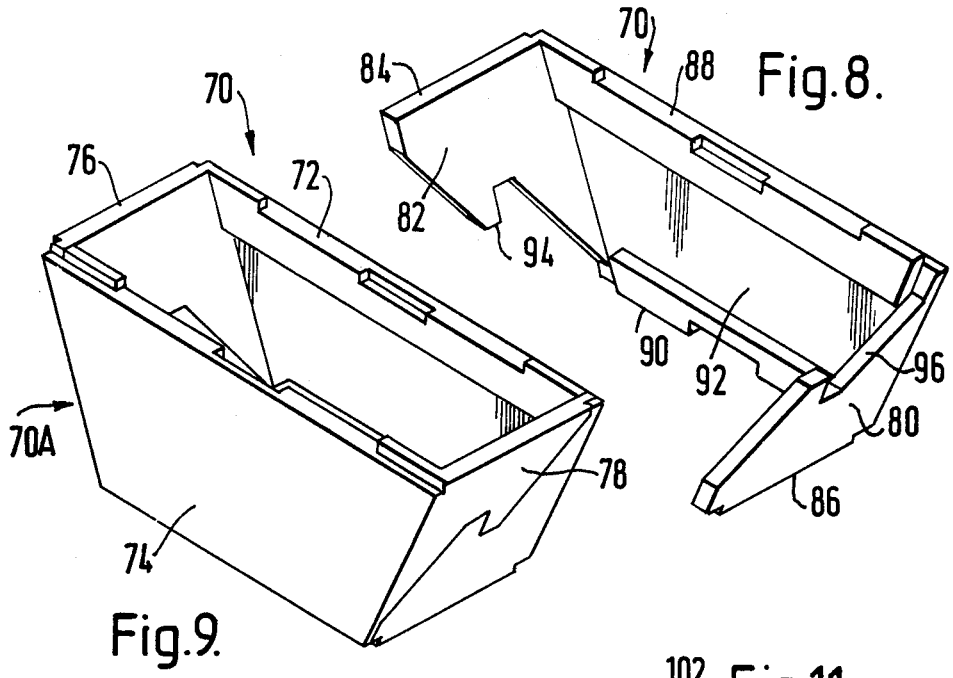
Fig.8.
Fig.9.
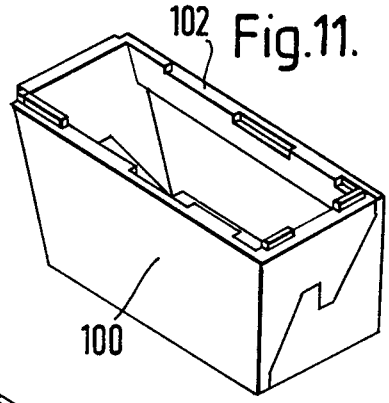
Fig.11.
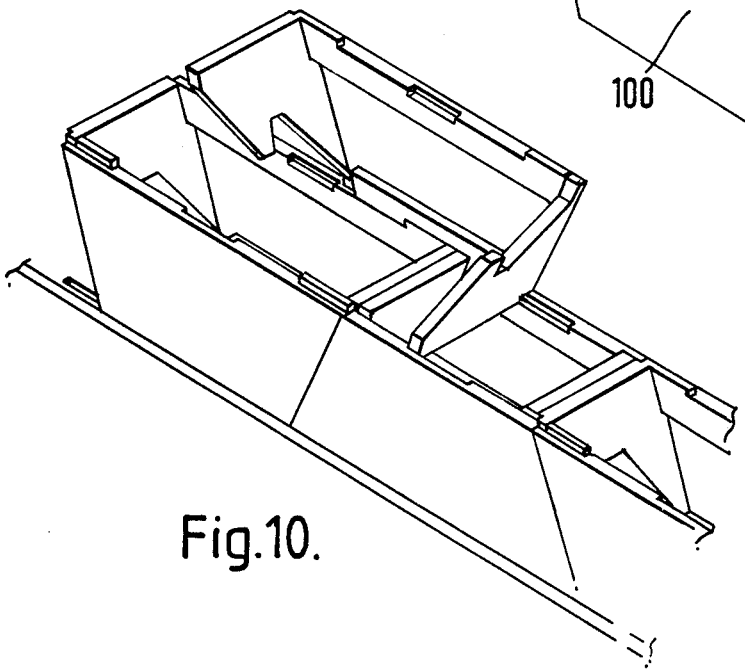
Fig.10.

BUILDING ELEMENT AND A CONSTRUCTION METHOD USING SUCH AN ELEMENT

This is a continuation of application Ser. No. 635,395, filed July 30, 1984.

This invention relates to a building element and to a method in which a number of such elements are used to construct a building or other structure.

The invention is primarily applicable to elements for construction of buildings in remote regions or when conventional materials such as concrete or bricks are either scarce, too expensive, or too difficult to transport.

It is an object of this invention to provide a means of constructing buildings making use of local material where possible and preferably using relatively unskilled labour.

According to a first aspect of this invention a building element comprises a shell which defines an interior space for receiving a filler material, wherein the shell includes at least a continuous first side wall and two end walls, the end walls being inclined relative to each other so that the element can form part of a stack of similar elements. The preferred element further comprises a second side wall opposite to and inclined relative to the first side wall. According to a second aspect of the invention, a method of producing a building or structure, which may make use of such elements, comprises the steps of providing a plurality of trapezoidal shells, arranging the shells in an abutting relationship to form a hollow wall, and filling the shells with a filler material such as a particulate mineral material. This material may be sand or gravel and may include a binder such as cement.

In this way, a permanent structure can be created from the combination of, on the one hand, pre-formed elements which, in terms of the volume of the structure produced, are relatively convenient and inexpensive to transport, and, on the other hand, a low cost filler material available close to the site of the structure. In other words, a very large proportion of the volume of the finished structure can be provided in the form of locally available loose fill material, the remainder being constructed to provide more than four times as much walling as could be imported in the form of brick, stone, or concrete blockwork. Solar gain performance of a structure using the preferred elements to be described hereinafter is comparable to that of brick, stone or concrete walls.

According to a third aspect of the invention, a building element comprises a shell having an interior space defined by a trapezoidal first side wall and two end walls which are connected to opposite ends of the side wall. The element may have a second trapezoidal side wall inclined relative to the first side wall so that the shell is in the form of a truncated pyramid of generally rectangular cross-section. In order tl:at such elements can be used to form a wall having horizontal courses and vertical outer surfaces, the pyramid-shaped shell may have rectangular open ends lying in parallel planes perpendicular to the first side wall. These shells are designed to be laid in double layer courses, the first side walls of the inner layer of shells constituting a vertical inner surface, and the first side walls of the outer layer constituting a vertical outer surface, with each shell overlapping the join between shells in the course below.

A fourth aspect of the invention provides a building element comprising a generally planar side wall having a top edge and a bottom edge, and two end wall portions integrally formed at the ends of the side wall and lying in planes which are inclined relative to each other, each end wall portion having means for interlocking with a respective end wall portion of another, similar element thereby to form an interlocked assembly having twc side walls and two end walls. Such an element is particularly suitable for single layer walls since two such elements, which, individually, are stackable, when fitted together can be used to construct a four-sided hollow shell having two parallel vertical side walls connected together at each end by inclined end walls.

To assist penetration of the filler material through a walled structure constructed from elements in accordance with the invention, the end walls and, where appropriate, the second side walls of the elements may have apertures allowing the material to flow between the interior surfaces of elements placed end to end or side by side. Such apertures may be so large that the walls comprise an open framework providing no more than a connection between the bearing surfaces for abutting neighbouring elements.

The elements themselves may be moulded in plastics materials, glass reinforced cement or modified cement such as that sold by I.C.I. Limited under the trademark NIMS. A further possibility is a mixture of cement and expandable polystyrene such as that manufactured by B.P. Chemicals under the trade mark RIGIPORE. Elements using these materials can be made to relatively precise dimensions, thus overcoming one of the disadvantages of known dry wall construction methods which require concrete blocks moulded to very close tolerances for satisfactory interlocking. The elements can be manufactured with a finished outer surface requiring no application of plaster or rendering, and glass-reinforced cement in particular has the advantage that it can be drilled or sawn and can accept nails.

The invention includes within its scope elements used as a toy, when they are preferably manufactured from paper pulp or foamed plastics material, and are used to construct walls with or without an internal filler material.

The invention will now be described by way of example with reference to the drawings in which:

FIG. 8 is a perspective view of a second embodiment of element in accordance with the invention suitable for constructing a single layer wall;

FIG. 9 is a perspective view of two of the elements of FIG. 8 shown fitted together;

FIG. 10 is a perspective view of part of a wall constructed from the elements of FIGS. 8 and 9; and FIG. 11 is a perspective view of an assembled pair of elements for use at a corner or jamb closure.

Figure 1:
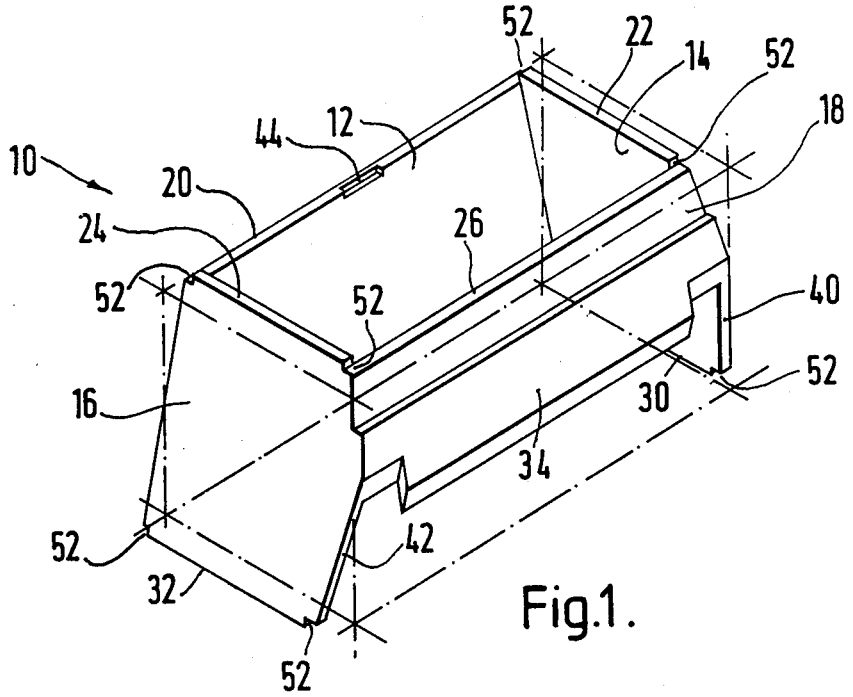
FIG. 1 is a perspective view of a building element in accordance with the invention viewed from the top and inner side.
Figure 2:
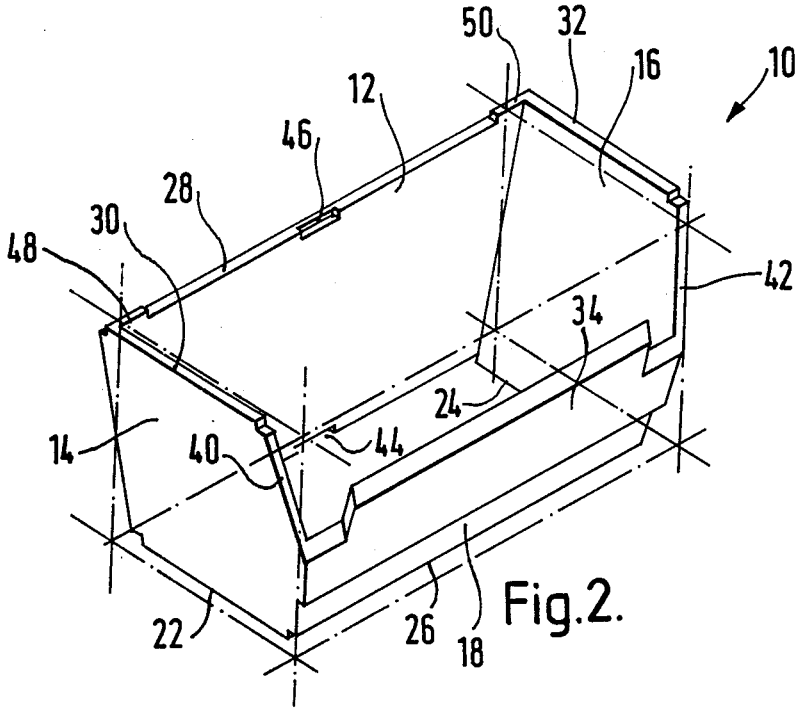
FIG. 2 is a perspective view of the element of FIG. 1 viewed from the bottom and inner side.

Referring to the isometric views in FIGS. 1 and 2, a 'standard' shell 10 for use on a double layer wall is in the form of a truncated pyramid having an outer side wall 12, two inclined end walls 14 and 16, and an inclined inner side wall 18. The four walls 12 to 18 have upper edges 20, 22, 24 and 26 forming a rectangle lying in an upper interface plane for engaging the edges of shells in an adJoining course. The lower edges 28, 30 and 32 of the first side wall and the end walls form part of another rectangle lying in a lower interface plane also for engaging the edges of shells in an adjoining course. Since the shell 10 is intended for a wall having horizontal courses and a vertical outer surface, the first side wall 12 has parallel upper and lower edges 20 and 28, and the interface planes are parallel to each other and perpendicular to the side wall 12.

In this description, the terms 'upper' and 'lower' are used for convenience and denote the open faces of the shell 10 as shown in FIG. 1. However, in practice the shells are used both in the orientation shown in FIG. 1 and inverted as shown in FIG. 2, as will be seen below from the description referring to FIGS. 4 and 5.

Figure 3:
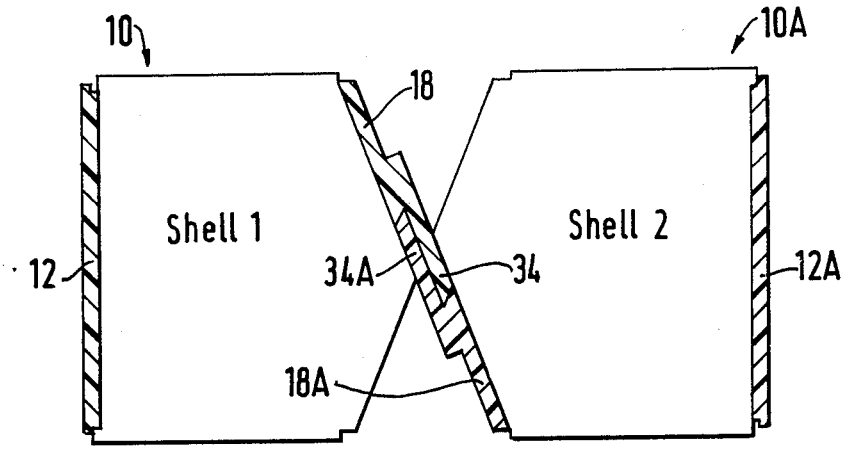
FIG. 3 is a cross section of one course of a double layer wall constructed from elements such as that shown in FIGS. 1 and 2.

To aid the stability of a wall constructed from the shells 10, the inner side wall 18 may be stepped and cutaway to provide an inner rebate and a tongue 34. It will be seen from FIG. 3 that the tongues 34 and 34A of shells 10 and 1OA placed alongside one another in a common course overlap each other and are received in the rebates behind the tongues. It should be noted that these details of the inner side wall 18 are not shown in FIGS. 4 to 6 for clarity, and in particular to enable the manner in which the trapezoidal configuration of the shells enables them to be fitted together in a regular overlapping relationship.

Figure 4:
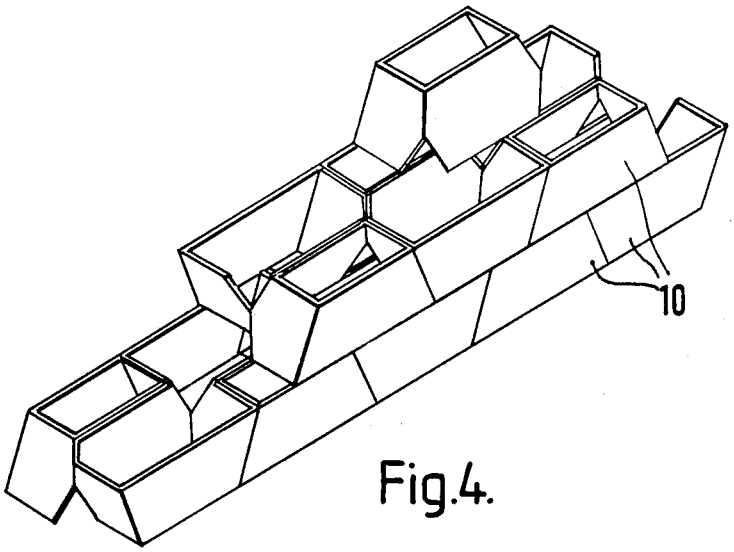
FIG. 4 is a simplified perspective view of part of a wall constructed from elements as shown in FIGS. 1 to 3.
Figure 5:
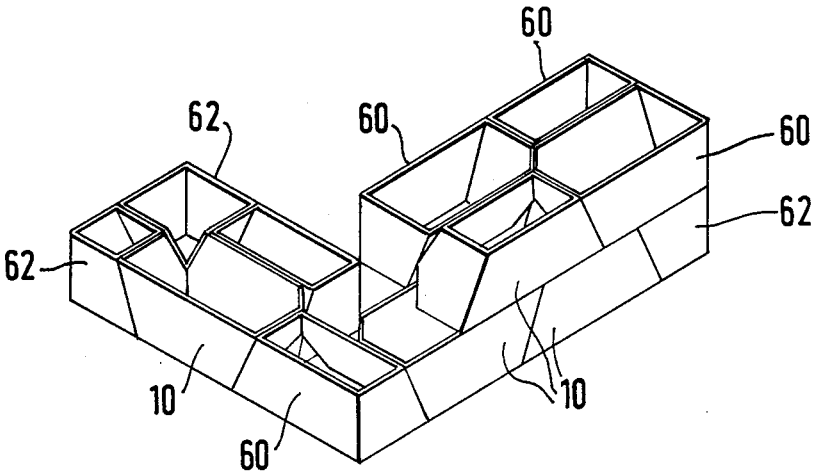
FIG. 5 is a simplified perspective view of a corner wall.

Referring to FIGS. 4 and 5 in conjunction with FIGS. 1 and 2, the shells 10 are laid in double width courses with successive shells in each row alternating between the orientation of FIG. 2 and the inverted orientation. Thus, the joins visible on the outer surfaces of the wall are inclined alternately one way and then the other. For each shell in the outer row, there is a neighbouring oppositely oriented shell in the inner row, interlocked by means of the tongues 34 in the manner shown in FIG. 3. As will be seen from FIGS. 1 and 2, the end walls 14 and 16 are not strictly trapezoidal in the sense that one corner of the trapezoid is cut away along edges 40 and 42. In the simplified representations of the shells in FIGS. 4 and 5, these cut-outs appear as notches in the inner corners of the shells allcwing the junction between the inner side walls 18 to be alternately nearer and further from the outer surface of the wall.

For ease of assembly and location the upper and lower edges of each shell 10 have recesses 44, 46 and projections 48 and 50. Due to the overlapping of shells in successive courses, the projections 48, 50 of each shell fit into the recesses 44 and 46 respectively of two shells on the course immediately above or below. Small shoulder cutouts 52 (FIG. 1) at the corners locate on the edges of adjoining shells.

The wall shown in FIG. 4 is composed entirely of shells like that of FIGS. 1 and 2. At closure locations, e.g. corners and door jambs, modified shells 60 and 62 are used, as shown in FIG. 5, to provide a vertical closure surface.

Figure 6:
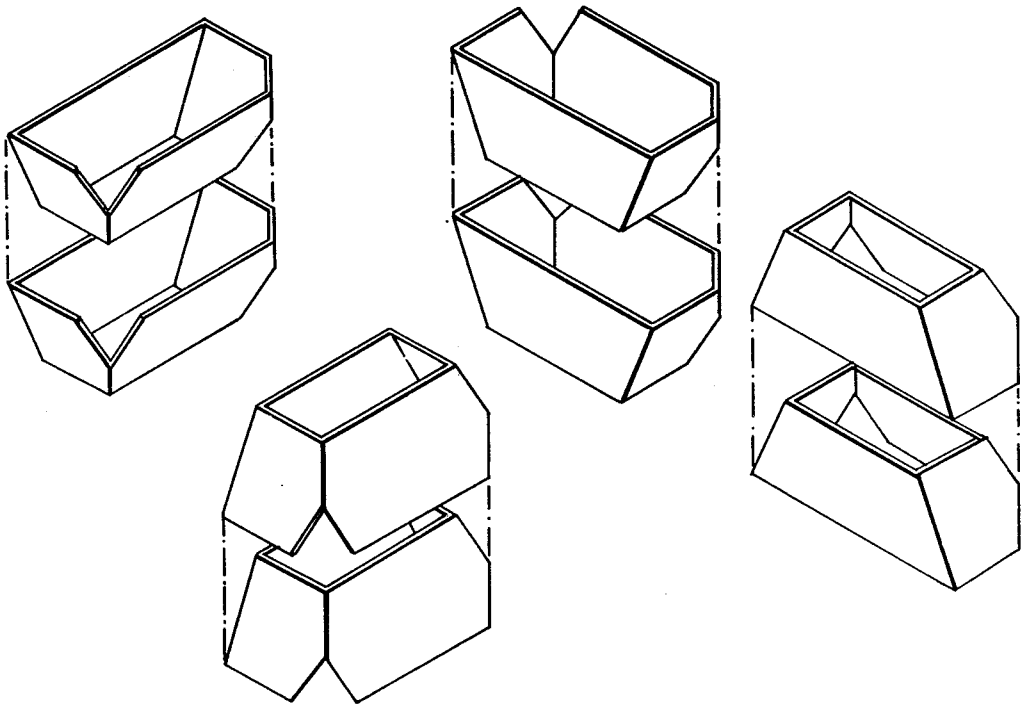
FIG. 6 is a simplifed perspective view showing how elements as shown in FIGS. 1 and 2 can be stacked inside each other.

The manner in which the shells 10 can be stacked for transporting and storage is shown in FIG. 6.

Figure 7:
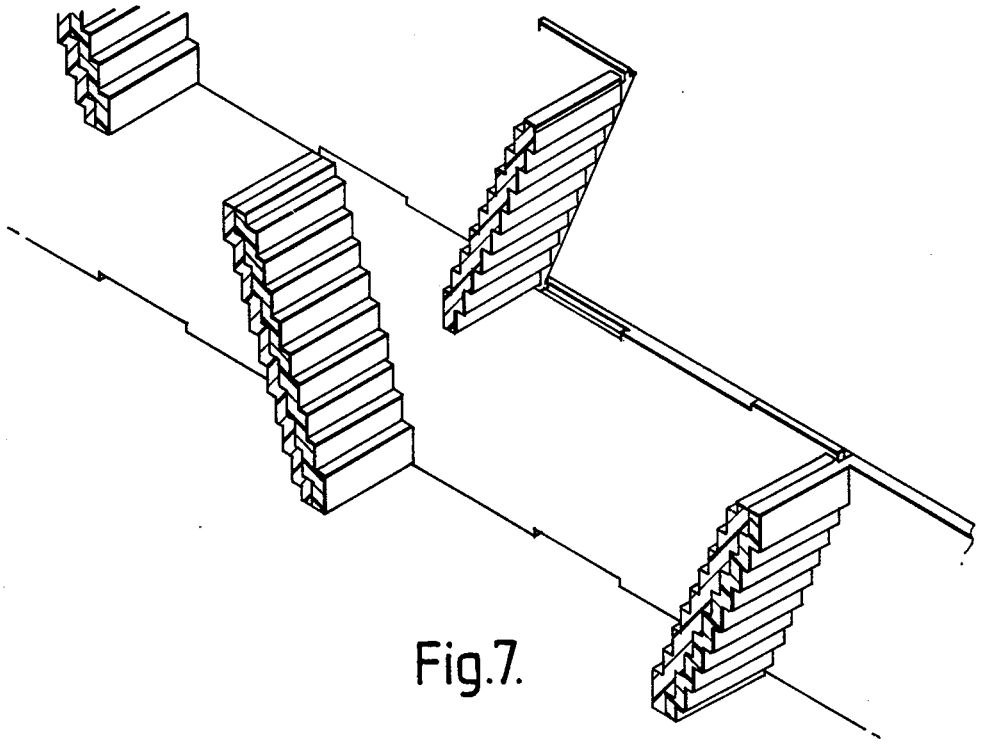
FIG. 7 is a fragmentary perspective view of parts of elements similar to that of FIGS. 1 and 2 but having modified end walls.

To further add to the stability of the wall prior to and after filling, the end wall may be provided with interfitting steps as shown in FIG. 7.

In many situations, walls of the thickness shown in FIGS. 4 and 5 are not required, particularly in the case of inner partitioning walls, for example, between rooms. In accordance with the invention a thinner wall may be constructed using half shell elements 70 as shown in FIGS. 8 to 11. Each half shell 70 interlocks with another identical half shell 70A (FIG. 9) to form a full shell having parallel trapezoidal vertical side walls 72 and 74 and inclined end walls 76 and 78 which can be laid in courses as shown in FIG. 10 to produce a single layer wall having continuous vertical outer surfaces.

The end wall portions 80, 82 (FIG. 8) of the half shell extend the full width of the full shell to reduce the risk of relative vertical movement, and have respective edges 84 and 86 which are co-extensive with the upper and lower edges 88 and 90 respectively of the side wall 92. The opposite edges 94 and 96 of the end wall portions 80 and 82 have interlocking hook portions for locking the two half shells in the assembled full shell configuration.

Referring to FIG. 11, special elements 100 and 102 each having one vertical end wall portion are provided for corner and jamb closures.

By splitting the shells into half shells and retaining the trapezoidal or semi-trapezoidal inner and outer profiles in side elevation the ability to stack the elements is retained.

All of the embodiments described above are suitable for the erection of a structure which may be filled with a loose fill material such as sand or gravel to form a permanent structure. The filling material may be poured into the shells after each course has been laid, but in the preferred method, several courses of shells are laid, and then filled in one operation, the filler material flowing down through the shells to fill all interior spaces. If cement is used as a binder, for example in a 'no-fines' concrete, weight to weight ratios as low as 1 part cement to 15 parts loose fill material can be used.

An increase in stabilty of walls constructed from the shells described above can be obtained by post-tensioning using steel cables or rods extending vertically in the wall, tensioned to hold the courses together. This technique is particularly applicable when the shells are used for internal partitioning and are left unfilled, and in earthquake zones where it has the advantage of providing a stabilised structure without the necessity for constructing a frame.

Rods or dowels can also be used internally to hold together neighbouring shells in each course. This may be carried out by cutting a vertical bore in each end wall of the shells so that a dowel or rod passed vertically through coaxial bores in an abutting pair of end walls holds the two respective shells together and prevents relative vertical movement.

To summarise, a lightweight building element is moulded in the form of a three or four sided shell defining an interior space for receiving a filler material. The element is trapezoidal or semi-trapezoidal in at least one elevation so as to be stackable with a plurality of identical elements for ease of transportion and storage. The method of the invention involves laying the elements in courses and then filling the elements from above with a loose relatively heavy filler material such as gravel or sand to form a solid structure. The shape of the elements is such that, although they are individually non-rectilinear, they produce a perfectly rectilnear finished structure.

We claim:

1. A building element for use in the construction of a substantially smooth and vertical parallel-faced wall comprising a plurality of such elements laid in courses, the element comprising a shell for receiving a filler material subsequent to incorporation of the shell in said wall, wherein the shell includes one continuous side wall and two end walls defining an interior space which is open in an upward and a downward direction and said side wall and said end walls having upper edges which lie generally in a first interface plane and lower edges which lie generally in a second interface place parallel to the first interface plane, both of said planes being perpendicular to the side wall, wherein the shell further includes integrally formed key means associated with at least one of the upper edges and lower edges of the side wall for locating the shell with respect to other shells in adjacent courses in said substantially vertical wall, with the upper and lower edges of the one side wall engaging lower and upper edges respectively of side walls of adjacent courses, and wherein the said end walls of the element are inclined with respect to each other and are so shaped that, prior to construction of said substantially vertical wall, the shell can form part of a stack of similar shells for the purposes of storage and transportation with the major part of each shell received within another such shell.

2. A building element according to claim 1 wherein the shell further comprises a second side wall opposite to and inclined relative to the first side wall.

3. A building element according to claim 2, wherein the shell is a one-piece moulding.

4. A building element according to claim 1, wherein each end wall is joined to the first and second side walls along respective lines of intersection which are inclined relative to each other.

5. A method of producing a substantially smooth and vertical parallel-faced wall for a building or other structure comprising the steps of providing a plurality of wall elements each comprising a shell having an interior space defined by one continuous side wall and two end walls, said end walls of an element being inclined with respect to each other, and said side wall and end walls having upper edges which lie generally in a first interface plane and lower edges which lie generally in a second interface plane parallel to the first interface plane, both of said planes being perpendicular to the side wall and wherein the shell further includes integrally formed key means associated with at least one of the upper edges and lower edges of the side wall for locating the shell with respect to other shells in the adjacent courses in said substantially vertical wall, with the upper and lower edges of the one side wall engaging lower and upper edges respectively of the side walls of adjacent courses, and being so shaped that each shell can form part of a stack of similar shells for the purposes of storage and transportation with the major part of each shell received within another shell, and arranging the elements in an abutting relationship to form a hollow wall having a substantially smooth, flat vertical outer surface formed from said side walls of the elements.

6. A method according to claim 5, wherein the filler material is a particulate mineral material.

7. A method according to claim 6, wherein the filler material includes a binder.

8. A former for use in conjunction with a plurality of like formers in the construction of walls of buildings or of other structures by the dry assembly of the formers into an interlocked permanent shuttering assembly enclosing communicating spaces for post-assembly filling with a comparatively heavy mineral material, wherein the former comprises a thin shell having a first side wall in the form of a trapezoid with parallel upper and lower edges and two side edges inclined with respect to each other and with respect to said upper and lower edges, and having two end walls inclined with respect to each other and joined to said side wall at said side edges so as to be perpendicular to said side wall, whereby the former may be nested inside another like former for the purpose of transportation and storage, and wherein said upper and lower edges have key means for engaging corresponding key means in the lower and upper edges of like formers in courses of the assembled structure below and above respectively.

9. A former according to claim 8, including means linking the end walls on the opposite of the shell from the side wall.

10. A former according to claim 9, wherein the linking means comprises a second side wall inclined with respect to the first-mentioned side wall.

11. A former according to claim 10, wherein the second side wall includes means for interlocking with corresponding interlocking means on the second wall of an adjacent like former.

12. A former according to claim 8, wherein each end wall is generally in the form of a trapezoid with one corner removed.

13. A former according to claim 8, wherein said key means are shaped to resist lengthwise movement with respect to the side walls of said formers in adjacent courses.

14. A shell element for use in the construction of a substantially smooth and vertical parallel-faced wall comprising a plurality of such elements laid in courses, said element being shaped for receiving a filler material subsequent to incorporation of said element in said wall, wherein said element comprises:

a first side wall in the shape of a trapezoid for forming part of the exterior surface of said parallel-faced wall, and having parallel upper and lower edges and two side edges which are inclined with respect to each other;

to end walls joined to said first side wall along respective ones of the side edges thereof, extending perpendicularly from said side wall, and inclined with respect to each other; and an integral linking member extending between the respective edges of said end walls on the opposite side of the element from said first side wall;

whereby the side wall, end walls and linking member define an interior space which is open to the top and the bottom of the element for receiving the filler material, and prior to incorporation in a wall, for receiving a like element so that a plurality of such elements may be transported and stored nested inside each other for compactness.

15. A shell element according to claim 14, wherein the linking member comprises a second side wall inclined with respect to said first side wall.

16. A shell element according to claim 15, wherein the second side wall incorporates means for interlocking with corresponding interlocking means of the second side wall of an adjacent like element.

17. A shell element according to claim 14, wherein the upper and lower edges of said first side wall include key means for engaging corresponding key means in the lower and upper edges of like formers in courses of the assembled wall below and above respectively.

18. A former for use in conjunction with a plurality of like formers in the construction of walls of buildings or of other structures by the dry assembly of the formers into a interlocked permanent shuttering assembly enclosing communicating spaces for post-assembly filling with a mineral filler which constitutes the major part of the mass of the walls, wherein the former comprises a thin shell in the general form of the frustum of a hollow right-angled pyramid with an outer side wall in the form of a trapezoid having parallel upper and lower edges with means for interlocking with the lower and upper edges of like formers in courses above and below respectively, and having side edges which are inclined with respect to each other and oppositely inclined with respect to the upper and lower edges.

19. A former according to claim 18, wherein the shell has an inner side wall including means for interlocking with like means on the inner side wall of an adjoining former.

20. A shell element for use in the construction of a substantially smooth and vertical parallel-faced wall comprising a plurality of such elements laid in courses, said element being shaped for receiving a filler material subsequent to the incorporation of said element in said wall, wherein said element comprises:

a first side wall in the shape of a trapezoid for forming part of the exterior surface of said parallel-faced wall, and having parallel upper and lower edges and two side edges which are inclined with respect to each other; and two end walls joined to said first side walls along respective ones of the side edges thereof, extending perpendicularly from said side wall, and inclined with respect to each other;

said side wall and end walls defining an interior space for receiving said filler material and, prior to incorporation of the element in said parallel-faced wall, for receiving a like element so that a plurality of such elements may be transported and stored nested inside each other for compactness;

said end walls further being shaped to interlock with the end walls of an identical element to form a four-sided shell, with each end wall extending substantially the full width of said four-sided shell.

21. A four-sided shell comprising two elements as defined in claim 20 with respect end walls interlocked and with one shell inverted with respect to the other.

* * * * *